US008510874B2

(12) United States Patent
Duboc

(10) Patent No.: US 8,510,874 B2
(45) Date of Patent: Aug. 20, 2013

(54) TOILET PLUNGER CLEANING SYSTEM

(76) Inventor: Carol Duboc, Pacific Palisades, CA (US)

( * ) Notice: Subject to any disclaimer, the term of this patent is extended or adjusted under 35 U.S.C. 154(b) by 313 days.

(21) Appl. No.: 13/022,282

(22) Filed: Feb. 7, 2011

(65) Prior Publication Data

US 2012/0000013 A1 Jan. 5, 2012

Related U.S. Application Data

(60) Provisional application No. 61/398,908, filed on Jul. 2, 2010.

(51) Int. Cl.
*E03D 11/00* (2006.01)
*A47L 1/08* (2006.01)

(52) U.S. Cl.
USPC ..... 4/255.11; 401/136; 401/138

(58) Field of Classification Search
USPC ..... 4/255.01–255.11; 222/525, 353, 222/330, 457, 162, 148; 401/195, 136, 138, 401/150, 170, 140–143; 239/271, 272
See application file for complete search history.

(56) References Cited

U.S. PATENT DOCUMENTS

| | | | | |
|---|---|---|---|---|
| 5,958,150 | A | 9/1999 | Borger et al. | |
| 6,383,457 | B1 | 5/2002 | Brown | |
| 6,701,540 | B1 | 3/2004 | Gabriel | |
| 7,124,450 | B2 | 10/2006 | Davidson | |
| 7,281,278 | B1 | 10/2007 | Biagi et al. | |
| 7,523,510 | B1 | 4/2009 | Biagi et al. | |
| 7,841,029 | B1 | 11/2010 | Williams | |
| 8,118,512 | B2 * | 2/2012 | Samartgis | 401/280 |
| 2007/0048069 | A1 * | 3/2007 | Moss | 401/270 |
| 2007/0081850 | A1 * | 4/2007 | DeRoma | 401/279 |
| 2009/0106887 | A1 * | 4/2009 | Dressel | 4/255.11 |
| 2010/0275356 | A1 * | 11/2010 | Hovsepian et al. | 4/255.11 |

* cited by examiner

*Primary Examiner* — Gregory Huson
*Assistant Examiner* — Christine Skubinna
(74) *Attorney, Agent, or Firm* — Greenberg Traurig, LLP

(57) ABSTRACT

A toilet plunger cleaning system wherein a toilet plunger is provided having a handle with an inner chamber and a plunger head. The handle chamber has a reciprocating cylinder filled with a cleaning fluid. A plurality of circumferentially spaced normally closed holes are provided in the handle communicating with holes in the cylinder. A lever on the exterior of the handle is activated to align the holes in the cylinder with the holes in the handle to release fluid about the lower portion of the handle and the plunger head to clean and/or sanitize the same.

7 Claims, 4 Drawing Sheets

TOILET PLUNGER CLEANING SYSTEM

RELATED APPLICATION

This application claims the benefit of and priority to U.S. Provisional Application Ser. No. 61/398,908, filed Jul. 2, 2010, the content of which is incorporated by reference herein in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field

The invention relates to a system for sanitizing a toilet bowl plunger after use in flushing a toilet.

2. Description of Relating Art Including Information Disclosed Under 37 C.F.R. 1.97 and 1.98

Toilet bowl plungers for flushing a toilet bowl to remove obstructions and clogging are well known. Such obstructions prevent water in the bowl from being flushed from the toilet bowl through the drain pipes into the sewage system.

Typically, such plungers include an elongated handle with an inverted cap-shaped plunger portion, generally of rubber or other resilient material, connected to an end of the handle. In order to plunge a clogged toilet bowl, the plunger portion is placed over the opening at the bottom of the bowl and pushed downwardly. The walls of the plunger portion collapse and force air under pressure through the opening. The plunger handle is pulled upwardly to release the plunger portion and restore it to its initial position. This applied suction usually dislodges any obstructions in the bowl and the bowl trap.

The plunger portion, and the lower part of the plunger handle, thus comes into contact with unsanitary material in the bowl. Rinsing the plunger portion in the now clean water in the bowl does not disinfect the plunger portion.

BRIEF SUMMARY OF THE INVENTION

The above-mentioned features and objects of the present disclosure will become more apparent with reference to the following description taken in conjunction with the accompanying drawings wherein like reference numerals denote like elements and in which:

It is an object of this invention to provide a system for disinfecting a plunger after flushing a toilet.

It is a further object of this invention to provide a system for quickly and easily applying a disinfecting solution about the lower part of the handle of a plunger and about the plunger head or portion and into the bowl after flushing.

These and other objects are preferably accomplished by providing a hollow chamber in the handle of a plunger for filling the same with a cleaning fluid. The handle has a plurality of normally closed apertures communicating with the interior of the chamber. A lever on the handle is activated to open the apertures and allow the cleaning fluid to flow out of the apertures down about the outside of the lower portion of the handle, over the plunger portion and into the toilet bowl.

After such cleaning treatment, the plunger portion can be placed in a pail or bucket for drying. A disposable bag, such as a plastic bag, may be placed in the pail or bucket for retaining any solution dripping off the plunger.

DESCRIPTION OF THE PREFERRED EMBODIMENT

Figure 1:
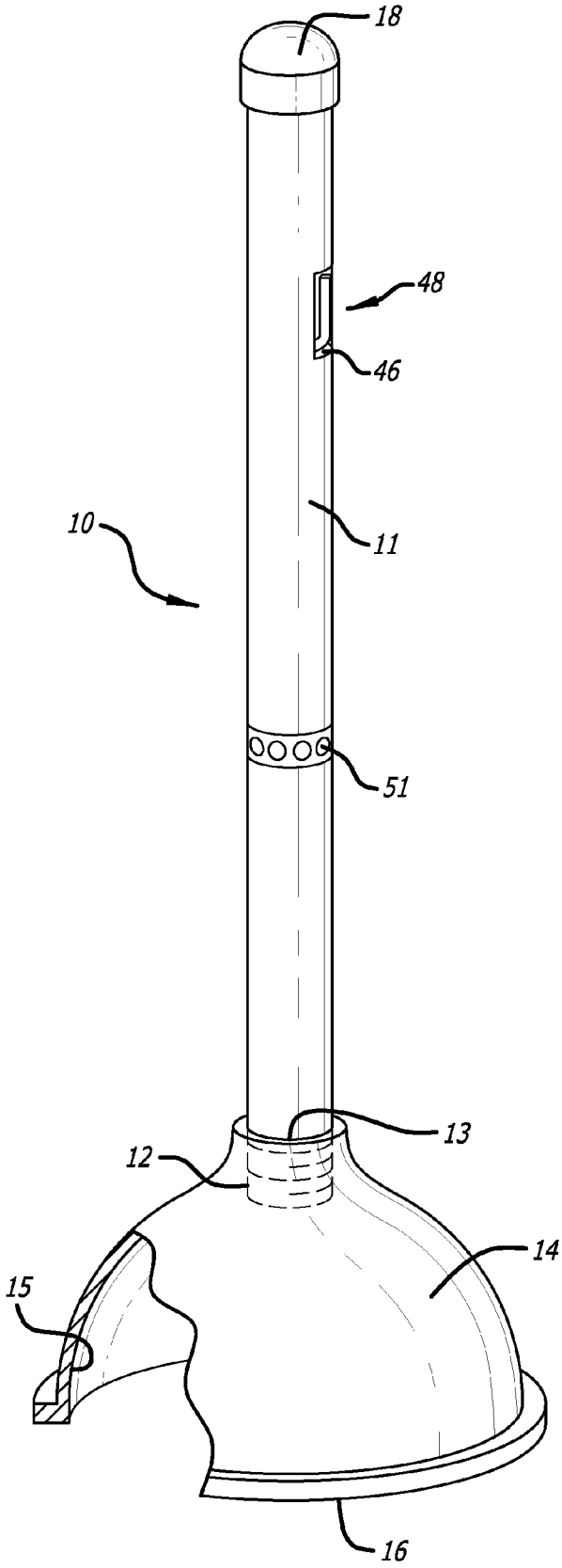
FIG. 1 is an elevational view of a plunger system, partly in cross-section, in accordance with the teachings of the invention.

Referring now to FIG. 1 of the drawing, a plunger system 10 in accordance with the teachings of the invention is shown. Plunger system 10 includes an elongated handle 11, which may be plastic, metal or wood, or any suitable material, having a threaded portion 12 at its lower end threaded into a threaded aperture 13 in the top of a conventional plunger portion or head 14. Plunger head 14 may be of rubber or any suitable resilient material having an inner cup configuration 15 as is well known in the art and open at bottom 16. Various types of such heads are known and any suitable head may be used. In fact, handle 11 may be removed from head 14 and threaded to a replacement plunger head as is also well known in the art.

Figure 2:
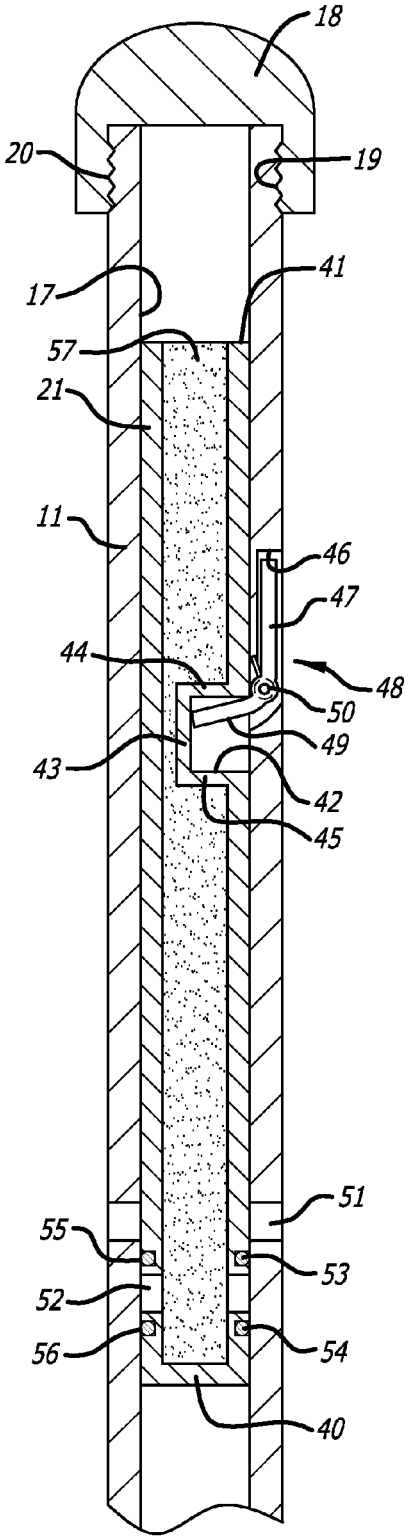
FIG. 2 is a view similar to FIG. 1 showing the handle partly in cross-section.

As particularly contemplated in the invention, and best seen in FIG. 2, the interior of handle 11 is hollow forming an internal chamber 17. Access to chamber 17 is provided through a removable cap 18 at the upper end of handle 11 which can be threaded thereon as seen at threads 19 on cap 19 mating with thread 20 at the upper end of handle 11. A reciprocating cylinder 21 is provided in chamber above the threaded end 12 (FIG. 1).

Cylinder 21 (FIG. 2) is hollow on its interior and slides along the inner wall of chamber 17. Cylinder 21 has a bottom wall 40 and is open at top 41. Cylinder 21 also has a chamber 42 communicating with the exterior of cylinder 21 closed off by inner wall 43 and upper and lower wall portions 44, 45 integral with inner wall 43 forming the chamber 42.

Handle 11 has a slot 46 having a first elongated portion 47 of a lever 48 disposed therein. Lever 48 also has a second elongated portion 49 extending into chamber 42, pivotally connected to first elongated portion 47, at pivot 50 connected to handle 11. The normal position of lever 48 is shown in FIG. 2.

A plurality of openings or holes 51 (see also FIG. 1) are provided about the periphery of handle 11, below slot 46, communicating the exterior of handle 11 with the interior thereof. As seen in FIG. 2, the wall of cylinder 21 normally blocks openings or holes 51, when cylinder 21 is in the FIG. 2 position, so no fluid therein can exit out of holes 51.

The lower end of cylinder 21 has spaced peripheral holes 52 fluidly communicating with holes 51 when cylinder 21 is in the FIG. 2 position. Just above and below openings 52 are provided resilient o-rings 53,54, respectively, in grooves 55, 56, respectively, for providing a seal between cylinder 21 and the inner wall of chamber 17 of handle 11.

In operation, cap 18 can be removed and chamber 17 filled with a suitable cleaning fluid. The cap 18 is then replaced. As seen in FIG. 2, holes 51 normally communicate with the interior of chamber 17 but, as seen, are blocked by cylinder 21 in the FIG. 2 position.

Figure 3A:
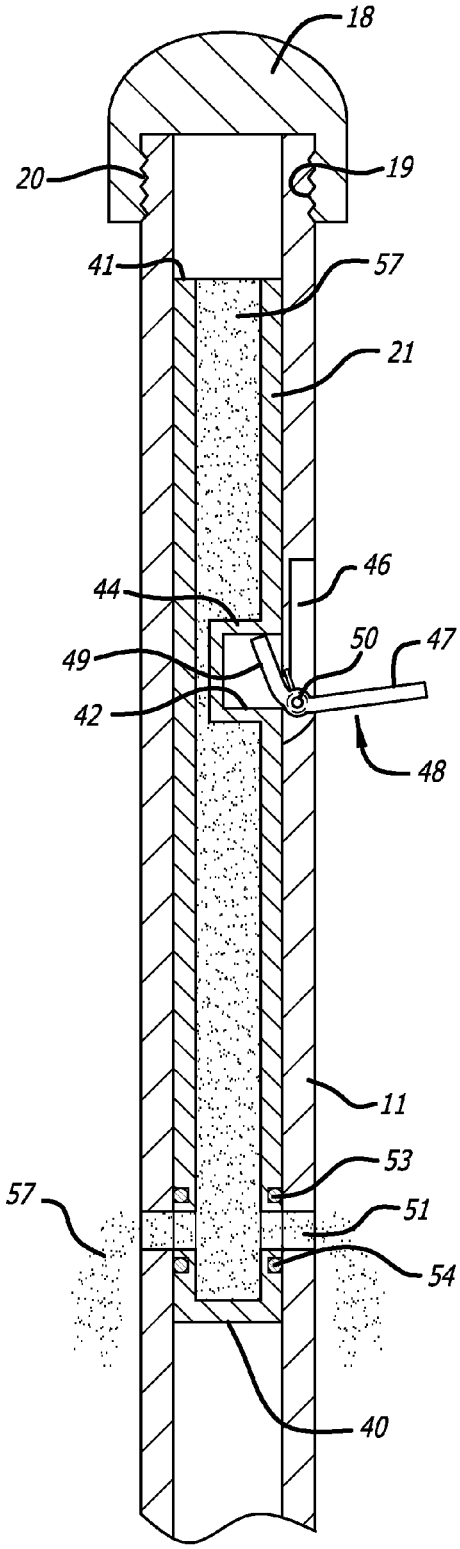
FIG. 3A is a view similar to FIG. 2 illustrating the application of a cleansing fluid to the lower part of the handle and the plunger head.
Figure 3B:
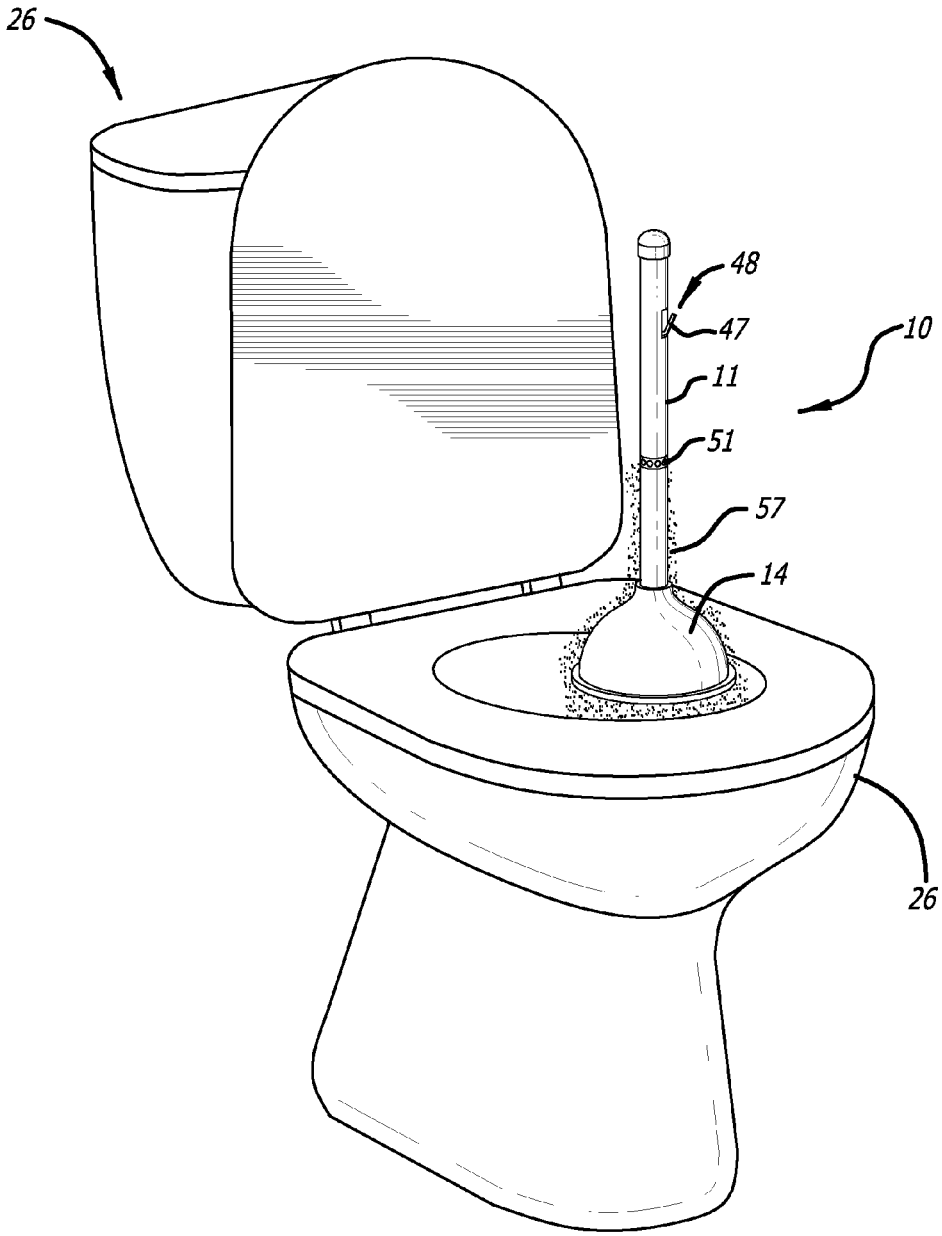
FIG. 3B is an elevational view illustrating depositing of cleaning fluid into a conventional toilet bowl.
Figure 4:
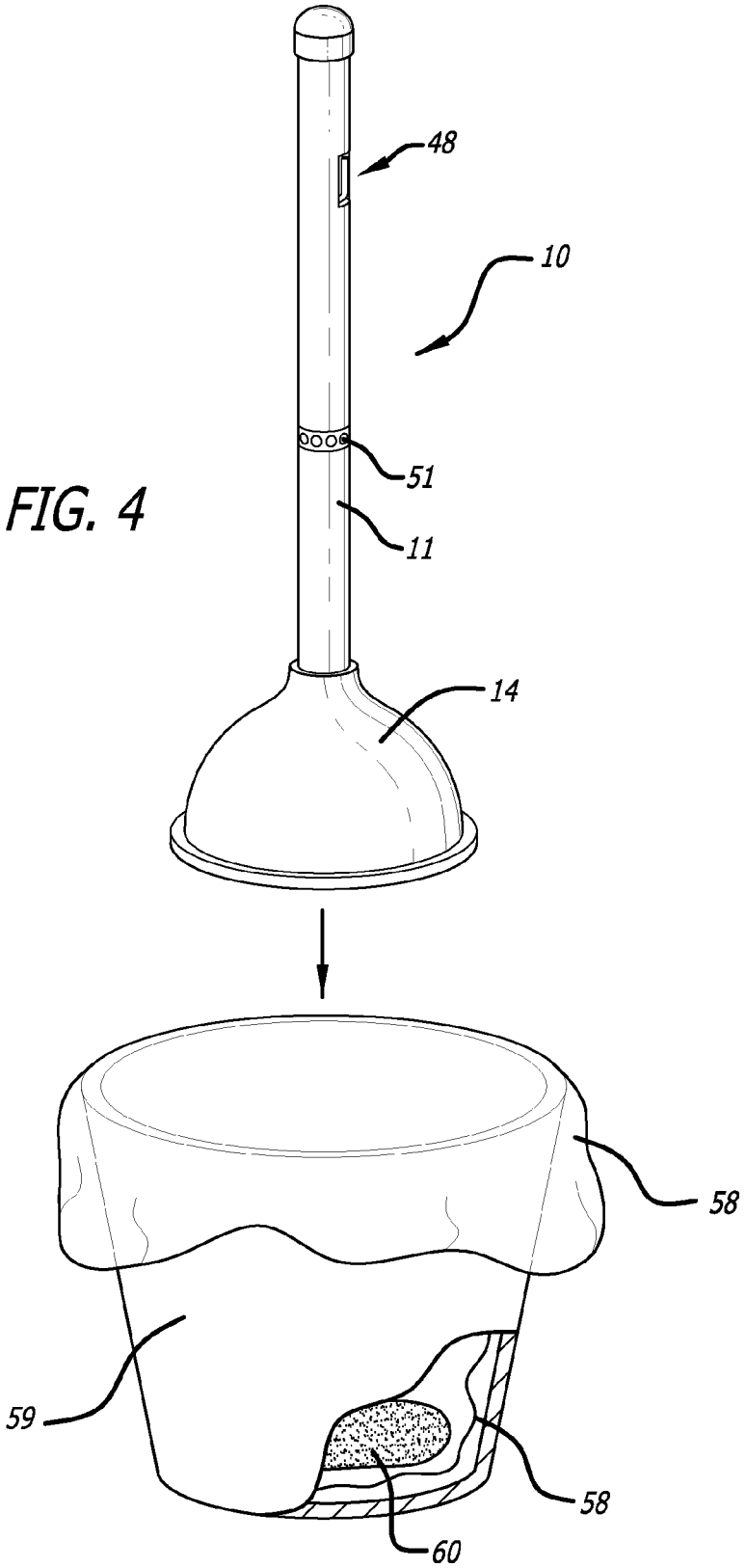
FIG. 4 is an elevation exploded view illustrating storage of the plunger in a bucket after application of the cleaning fluid.

As seen in FIG. 3A, when lever 48 is activated by pulling portion 47 outwardly, portion 49 engages wall 44 to lift cylinder 21 aligning holes 52 and 51. Fluid 56 exits out of holes 51 flowing down the lower part of handle 11, over the plunger portion 14, and into the fluid into the toilet bowl 26 shown in FIG. 3B. This disinfects the lower portion of handle 11 and plunger portion 14 and also injects the cleaning fluid, which may be any suitable sanitizing fluid, into the toilet bowl 26. Bowl 26 may now be flushed and the plunger 10 placed inside of a disposable plastic bag 58 in pail or bucket 59 as seen in FIG. 4. A removable sponge 60 may be disposed in the bottom of bucket 59 for absorbing water from the plunger 10.

It can be seen that there is disclosed a plunger cleaning system where the hollow interior of the handle of the plunger can be filled with a cleaning fluid and a lever activated to open holes in the handle to disperse the fluid. Any suitable operating system may be used to release the fluid. Thus, the toilet plunger cleaning system disclosed herein keeps the toilet bowl plunger clean without having to carry it across the floor to the sink or tub. The plunger has a hollow handle that has refillable antiseptic cleaning solution in it such as a bleaching fluid. Once the toilet is plunged, it is flushed and rinsed in the clean water. One pushes on the lever which will release the cleaning solution into the bowl, around the bottom half of the handle and around the plunger. The holes through which the solution may be about 5 inches or so above the bottom of the plunger portion so that the toilet water does not have a chance to go back in where the liquid comes out and the bottom of the handle is cleaned. A bucket or the like may be provided to put the plunger when finished. Such a bucket may be lined with a disposable plastic liner or have a sponge at bottom to allow the plunger head to dry.

Any suitable plunger head may be used. The handle 11 herein may be about 17" long, 1" in diameter and adapted to thread into a conventional plunger head. Such heads are generally about 4" in height and 6" in diameter, open at bottom and have a threaded socket at top.

Gravity would be sufficient to allow flow of water out of the aligned holes. However, if desired, any suitable means may be provided for ejecting fluid under pressure out of the aligned holes.

While the system has been described in a particular embodiment, various thereof may occur to an artisan and the scope of the invention should only be limited by the scope of the appended claims.

The invention claimed is:

1. A toilet plunger cleaning system comprising:

a plunger handle having an inner chamber with an inner wall and a cylinder reciprocal therein, said handle having a plurality of peripherally spaced holes communicating the inner chamber of said handle with the exterior thereof, said cylinder being open at the top and closed off at the bottom for containing a fluid therein, said cylinder having plurality of holes fluidly communicating the interior of said cylinder with the exterior thereof;

said cylinder having a chamber on the exterior thereof formed by upper and lower wall portions interconnected by an inner wall portion;

fluid release means accessible from the exterior of said handle for reciprocating said cylinder from a first position closing off said holes through said handle to a second position to release fluid from said cylinder, out of said holes in said cylinder, through the holes in said handle, and about the lower portion of said handle.

2. The cleaning system of claim 1 wherein said cylinder is in sliding engagement with the inner wall of said chamber.

3. The cleaning system of claim 2 wherein resilient o-rings are provided in spaced grooves above and below the holes in said cylinder.

4. The cleaning system of claim 1 said fluid release means includes a slot in said handle above the holes therein, a pivotable lever having a first extension portion mounted in said slot with a second extension portion pivotally attached thereto extending into the chamber in said cylinder and engaging the inner wall portion of said chamber when in said first position, and movable into engagement with the upper wall portion of said cylinder when said lever is pivoted thereby moving said cylinder to said second position releasing fluid out of the holes in said cylinder, through the holes in said handle, and down the lower end of said handle.

5. A toilet plunger cleaning system comprising:

a handle extending upwardly from a plunger head, said handle having an inner wall and a cylinder with a fluid chamber reciprocal therein, said plunger head having a top and bottom comprising a resilient member cup-shaped in configuration open at the bottom, the plunger head having said top attached to a terminal end of said handle;

a plurality of holes extending about the outer periphery of said handle above said plunger head in communication with the fluid chamber in said handle and a portion of said handle being disposed above where said handle is attached to said plunger head and below said holes, said holes communicating with the exterior of said handle; and fluid release means associated with said fluid chamber for selectively releasing fluid from said fluid chamber out of said holes, over the portion of said handle above said plunger head and below said holes down over said plunger head; and wherein the holes in said handle communicate with holes in said cylinder when said cylinder is in a position aligning the holes in said handle with the holes in said cylinder whereby fluid can exit from the holes in said cylinder through said holes in said handle.

6. The cleaning system of claim 5 wherein said cylinder is closed at the bottom and open at top.

7. The cleaning system of claim 5 wherein said fluid release means includes a lever accessible on the exterior of said handle engaging said cylinder and adapted to lift said cylinder from a first position whereby the holes in said cylinder are sealed off from the holes in said handle to a second position whereby the holes in said cylinder align with the holes in said handle.

* * * * *